United States Patent [19]

Bodine

[11] Patent Number: 4,471,838

[45] Date of Patent: Sep. 18, 1984

[54] SONIC METHOD AND APPARATUS FOR AUGMENTING FLUID FLOW FROM FLUID-BEARING STRATA EMPLOYING SONIC FRACTURING OF SUCH STRATA

[75] Inventor: Albert G. Bodine, 7877 Woodley Ave., Van Nuys, Calif. 91406

[73] Assignee: Albert G. Bodine, Van Nuys, Calif.

[21] Appl. No.: 348,880

[22] Filed: Feb. 16, 1982

[51] Int. Cl.[3] ..... E21B 43/26

[52] U.S. Cl. ..... 166/249; 166/177; 166/308

[58] Field of Search ..... 166/249, 177, 271, 308; 175/19, 55, 56, 325

[56] References Cited

U.S. PATENT DOCUMENTS

| | | | |
|---|---|---|---|
| 2,915,122 | 12/1959 | Hulse | 166/308 X |
| 3,016,093 | 1/1962 | Bodine | 166/249 |
| 3,016,095 | 1/1962 | Bodine | 166/177 |
| 3,220,476 | 11/1965 | Brandon | 166/308 X |
| 3,578,081 | 5/1971 | Bodine | 166/249 |
| 3,633,688 | 1/1972 | Bodine | 175/56 X |
| 3,848,672 | 11/1974 | Bodine | 166/249 |
| 3,965,982 | 6/1976 | Medlin | 166/308 X |
| 4,252,189 | 2/1981 | Bodine | 166/249 |
| 4,323,119 | 4/1982 | Bodine | 166/249 X |

*Primary Examiner*—George A. Suchfield

*Attorney, Agent, or Firm*—Edward A. Sokolski

[57] ABSTRACT

A device for fracturing earthen material includes an elongated stem member having a wedging tool attached to the distal end thereof and a sonic oscillator coupled to the top end thereof. The wedging tool has rib means formed on the outer portions thereof, these rib means in one embodiment being spaced around the circumference of the tool at approximately 90° intervals. The stem is lowered into a well to be serviced to stimulate the flow of fluid (generally oil) therefrom. With the tool ribs wedged against the sides of the well, sonic energy is coupled from the sonic oscillator into the stem. This energy may be at a frequency such as to cause resonant elastic vibration of the stem. The tool is fabricated of a hard elastic material, such as steel. The sonic energy is coupled from the wedging ribs of the tool to the earthen formation surrounding the well in a non-isotropic manner, i.e., along particular lines. The sonic energy tends to fracture the earthen formation with the tool being driven down the well by virtue of the bias force applied thereto by virtue of its own weight, the weight of the stem and that of the oscillator structure. As the tool is thus driven down the well, the leading edges of the ribs provide a wedging action which gives good acoustic coupling and engenders a splitting action of the earthen formation to loosen the fluid material contained therein.

7 Claims, 9 Drawing Figures

SONIC METHOD AND APPARATUS FOR AUGMENTING FLUID FLOW FROM FLUID-BEARING STRATA EMPLOYING SONIC FRACTURING OF SUCH STRATA

This invention relates to the servicing of wells, and more particularly to a method and apparatus for augmenting the flow of fluids from wells by coupling sonic energy to the sides of such wells in a non-isotropic manner through a sonic coupling tool.

Particularly in recent years with the increased interest in oilwell production, considerable efforts have been made to augment the output of wells by various servicing techniques. In the case of wells drilled into sedimentary formations, a common technique known as HYDRO-FRAC is employed wherein a well is intermittently subjected to high hydraulic pressure by forcing high pressure water therein to effect a failure of a portion of the surrounding earthen formation. Such failure or fracturing of the formation has the objective of opening up flow paths for the well liquid, thereby increasing the yield of the well. It is highly desirable, although difficult, in such fracturing to find producible regions in the sedimentary formation and concentrate the fracturing effort in these regions such that the desirable opening up of the well can more readily be accomplished. Unfortunately, the uniform hydraulic pressure will open up any weak zone including those of no interest. A significant problem is encountered with the use of hydraulic pressure in that this type of pressure tends to be isotropic, i.e., it provides equal pressure in all directions. Further, hydraulic pressure tends to be uniform and is therefore difficult to magnify in a particular localized region. Hydraulic liquid also contaminates the formation in gas wells where this invention can be applied to particular advantage.

Certain prior art techniques have been developed as described in my U.S. Pat. Nos. 3,016,095 and 3,189,092, wherein sonic energy is employed for use in fracturing an earthen formation. In these systems, the sonic energy is coupled through a liquid medium in the well bore to the formation to be fractured and hence tend to have some of the same basic shortcomings as the systems employing hydraulic pressure. A method and apparatus is described in my U.S. Pat. No. 3,578,081 for augmenting the flow of oil from oil-bearing strata wherein sonic vibrational energy is tightly coupled to the walls of an oilwell casing so as to vibrationally distort the casing in an elliptical pattern. In this system, the sonic energy is transferred to the surrounding oil-bearing strata to induce the migration of oil particles therein into the well. This system does not, however, involve the fracturing of the sedimentary formation and thus is not suited for situations where such fracturing is required to open up new flow paths.

The present invention overcomes the shortcomings of the prior art and is particularly suited for use in wells drilled into sedimentary formations where hard rock material is encountered. The system and method of the present invention achieves its desired end results by coupling sonic energy through a solid hard elastic wedging tool directly to the rock formation. This sonic energy is generated by means of a sonic oscillator located above the surface and transmitted to the wedging tool through an elongated elastic stem. The coupling between the hard solid wedging tool and the earthen material, both of which have impedance characteristics, tends to afford a good impedance match between the two. Further, sonic energy is coupled to the formation in a non-isotropic manner in particular predetermined directions wherein the concentrated energy is desired for optimum fracturing effect on the strata. The rock material is thus subjected to very high level sonic fatigue stresses and non-isotropic coupling bias can be employed to greatly magnify the effects of this fatigue force.

Basically, the system of the present invention does not require liquid in its implementation. However, if desired, it can be used in combination with hydraulic fracturing (HYDRO-FRAC). Where the system and device of the present invention is employed without hydraulic fracturing, it is possible to leave the sonic fracturing hardware in the well and treat the well therewith from time to time without interfering with or contaminating the normal flow of the fluid being mined. In this manner, also the sonic energy can be either delivered continuously or at frequent intervals for such purposes as, for example, shaking up the sedimentary formation to improve the uniformity of burning as with in-situ retorting of oil shale, in-situ leaching as in uranium mining, or for the leaching of old mine tailing piles. It is to be noted that the system of the present invention is much more economical in proportions as compared with hydraulic fracturing systems.

The system of the present invention comprises a stem member having a wedging tool fabricated of a hard elastic material such as steel at the distal end thereof and a sonic oscillator generally coupled to the upper end of the stem member. Sonic energy is delivered from the oscillator through the stem to the wedging tool which tool is lowered into the well from the above surface suspended oscillator and stem. The tool has wedging ribs formed along the outer surfaces thereof, these ribs in a typical embodiment being arranged around the circumference of the tool in opposing pairs, although such an arrangement is not a necessity. With the weight of the oscillator structure, the stem and the tool itself applying a downward bias force against the tool, while sonic energy is simultaneously applied thereto, the tool wedges itself against the sides of the well, the sonic energy being coupled to the desired local strata to effect fracturing thereof. The sonic energy is applied to the strata in predetermined directions with both vertical and radial force vectors. The sonic energy is applied to the stem preferably in a longitudinal vibrational mode and may be at a frequency such as to cause resonant elastic vibration of the vibration system comprising the stem and the tool.

It is therefore an object of the invention to augment the flow of fluid from a well.

It is a further object of the invention to provide an improved method and apparatus for fracturing earthen formations surrounding a well to provide increased fluid flow paths to the well.

It is still a further object of this invention to provide a more economical method and apparatus for augmenting the flow of fluid from a well in which non-isotropic fracturing of the sedimentary formation is employed.

Other objects of the invention will become apparent as the description proceeds in connection with the accompanying drawings of which:

Figure 1:
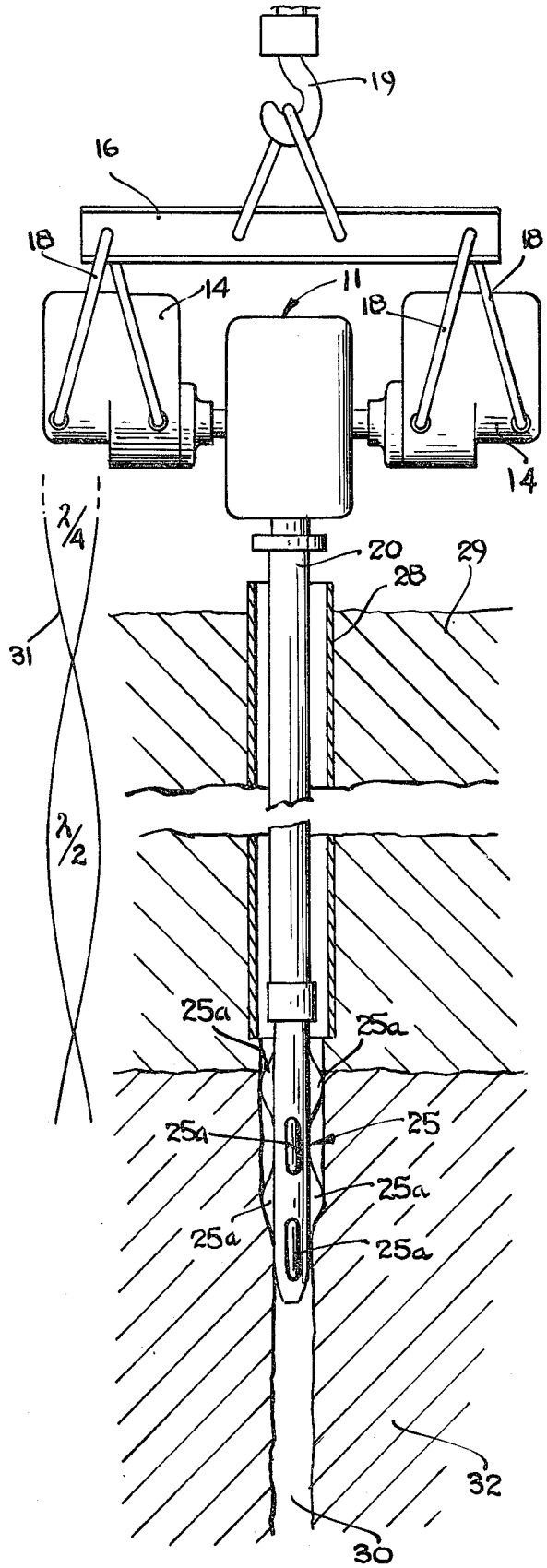
FIG. 1 is an elevational view of a first embodiment of the invention.

Referring now to FIG. 1, a first embodiment of the invention is illustrated. Sonic oscillator 11 comprises an orbiting mass oscillator formed by paired eccentric rotors which are driven by engines 14, as described in my U.S. Pat. Nos. 3,189,106 and 3,684,037. The oscillator-engine assembly is suspended from support beam 16 by means of suspension struts 18, beam 16 in turn being suspended from the hook 19 of a derrick (not shown). Rigidly attached to the vibratory output stem of oscillator 11 is a well stem member 20 which may be tubular in configuration and which is suspended from the oscillator. Fixedly and rigidly attached to the distal end of stem 20 is wedging tool 25 which is fabricated of a hard material such as steel. Extending outwardly from the sides of tool 25 are a plurality of rib members 25*a*, these rib members being arranged in opposing pairs, although such a paired arrangement is not essential. The ribs 25*a* are spaced circumferentially from each other around the tool at intervals of 90°, although, again, such 90° spacing is not essential.

Figure 3:
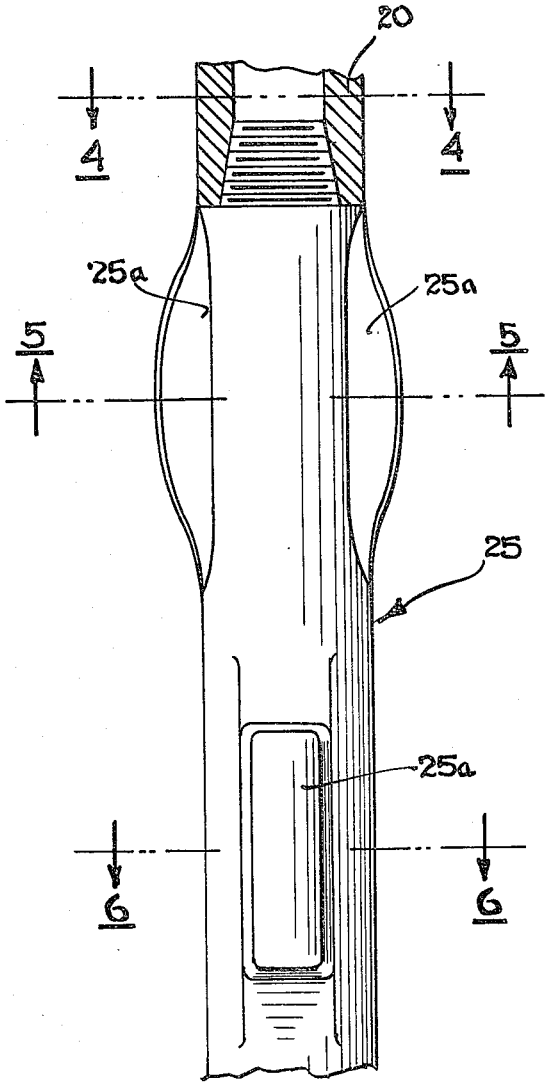
FIG. 3 is an elevational view illustrating one embodiment of the tool of the invention.
Figure 4:
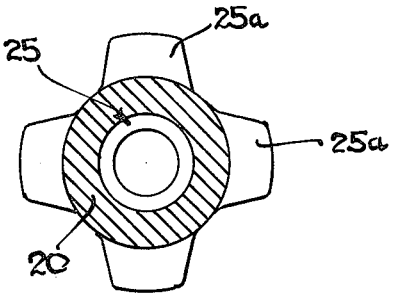
FIG. 4 is a cross-sectional view taken along the plane indicated by 4—4 in FIG. 3.
Figure 5:
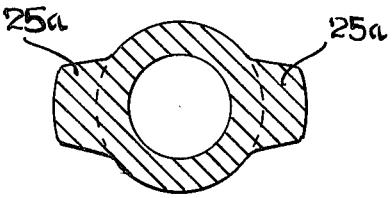
FIG. 5 is a cross-sectional view taken along the plane indicated by 5—5 in FIG. 3.
Figure 6:
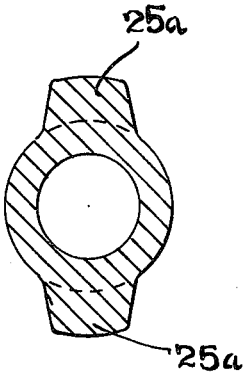
FIG. 6 is a cross-sectional view taken along the plane indicated by 6—6 in FIG. 3.

The arrangement and structure of the ribs can more readily be seen in FIGS. 3-6. Tool 25 may be threadably attached to stem 20, as illustrated in FIG. 3. As illustrated in FIG. 1, a well casing 28 is installed in the upper portions of the strata 29 into which the well is drilled with a narrower uncased well portion 30 being formed in the lower portion of strata 32.

The tool 25 is lowered on its suspension into the well with the rib portions 25*a* abutting against the sides of the lower uncased well portion in wedging engagement therewith by virtue of the bias force supplied by the weight of the tool itself, stem 20, oscillator 11 and the associated drive and suspension structure. With the ribs of the tool in such wedging engagement with the sides of the formation, sonic energy generated by oscillator 11 is transmitted to the tool and transferred to the formation therethrough. The matching impedance afforded by the common high impedance characteristics of the hard formation 32 and the ribs 25*a* affords good energy coupling between the two, assuring good transfer of energy to the strata. The sonic energy is coupled from ribs 25*a* in relatively unidirectional paths to assure concentration of such energy along such paths to enable the more efficient fracturing of weakened portions of the strata. As already noted, the oscillator may be driven at a speed such as to set up resonant elastic wave vibration of the stem and tool, thereby providing a substantially higher amplitude of vibration force as shown in FIG. 1 by $\frac{3}{4}\lambda$ wave pattern 31. The vibrational output of the oscillator is principally in a longitudinal vibrational mode, i.e., along the longitudinal axis of stem 20, although some radial components of vibration are also present.

Figure 2:
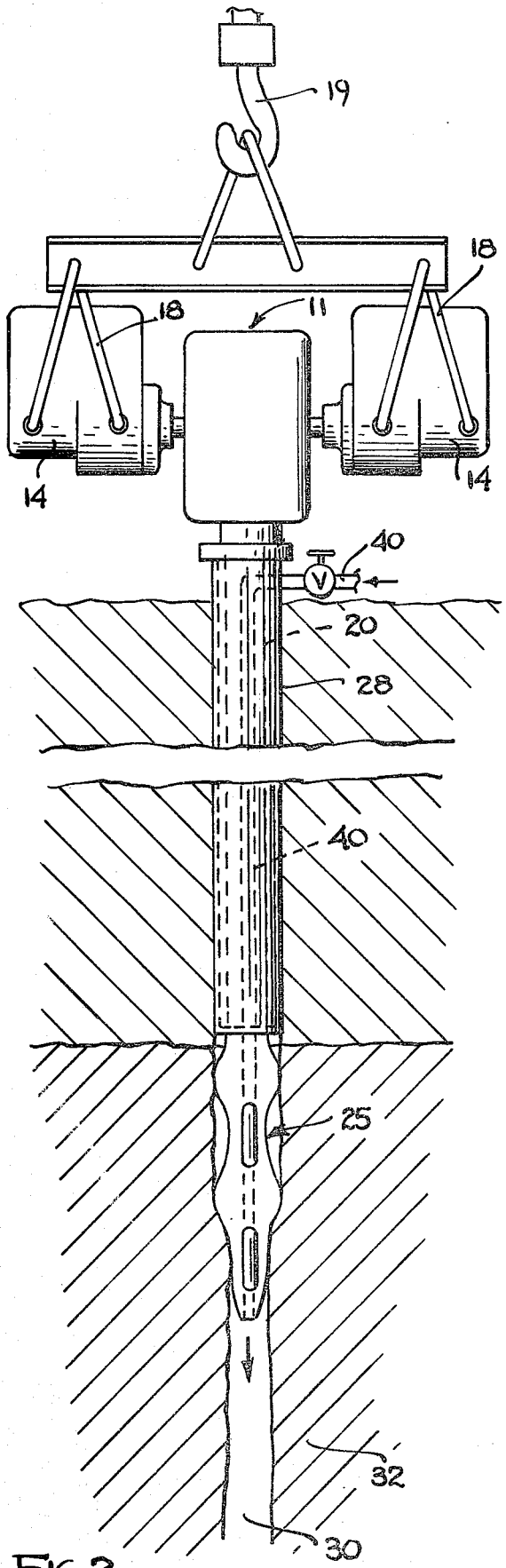
FIG. 2 is an elevational view of a second embodiment of the invention.

Referring now to FIG. 2, a second embodiment of the invention is illustrated. This second embodiment is similar to the first, except for the fact that hydraulic fracturing is combined with the sonic vibratory fracturing action. In this embodiment, pressurized liquid is fed through the stem and tool by means of pipe 40 and thence fed to the strata 32. In this manner, the combined hydraulic and sonic actions can be employed to augment the fluid output of the well. Otherwise, operation is the same as that for the first embodiment.

Figure 7:
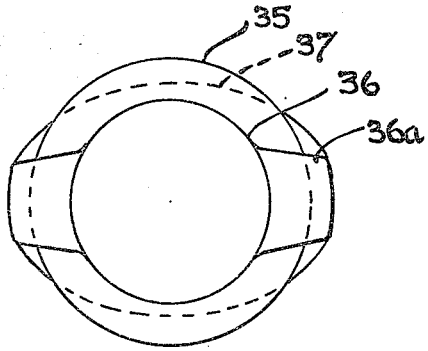
FIG. 7 is a diagrammatical view illustrating the operation of the device of the invention.

Referring now to FIG. 7, the operation of the device of the invention in effecting widening of the well is diagrammatically illustrated. The walls of the predrilled well are illustrated at 35; the walls of the wedging tool are illustrated at 36 with the rib portions thereof being shown at 36*a*, while the elliptical strain distortion of the well walls in response to the action of the tool is illustrated by dotted line 37, this being created by the downward and outward crowding of the tool ribs. As the tool is vibrated by the sonic system, while simultaneously being biased downwardly by the weight of the system and the tool itself, elliptical strain indicated by dotted lines 37 is likewise vibratory. The vertical vibration causes a local fluctuation of ellipticity with the walls of the well vibrating accordingly. Along with this substantially horizontal stress vibration effected by the elliptical cyclic straining, the system also applies vertical vibration to the region of the rock in view of the fact that the tool tightly grips the wall, and the longitudinal vibration mode engendered in the column provides this vertical vibration component to the surrounding strata. Such combined complex vibrational stress engendered in the formation, along with the stress caused by the strain of the elliptical distortion, results in a concentrated fatigue force environment capable of fracturing very hard and strong formations. By selecting optimum rib geometry for a given rock material and choosing optimum angular settings for the ribs of each tool, it is possible to increase the chances of obtaining interconnecting fractures between a pair of wells which are in proximity to each other. Such interconnection between adjoining wells is desirable in mining leaching, in circulating type of geothermal heat extraction (particularly from hot, dry magma), and for in-situ retorting, such as with oil shale.

Figure 8:
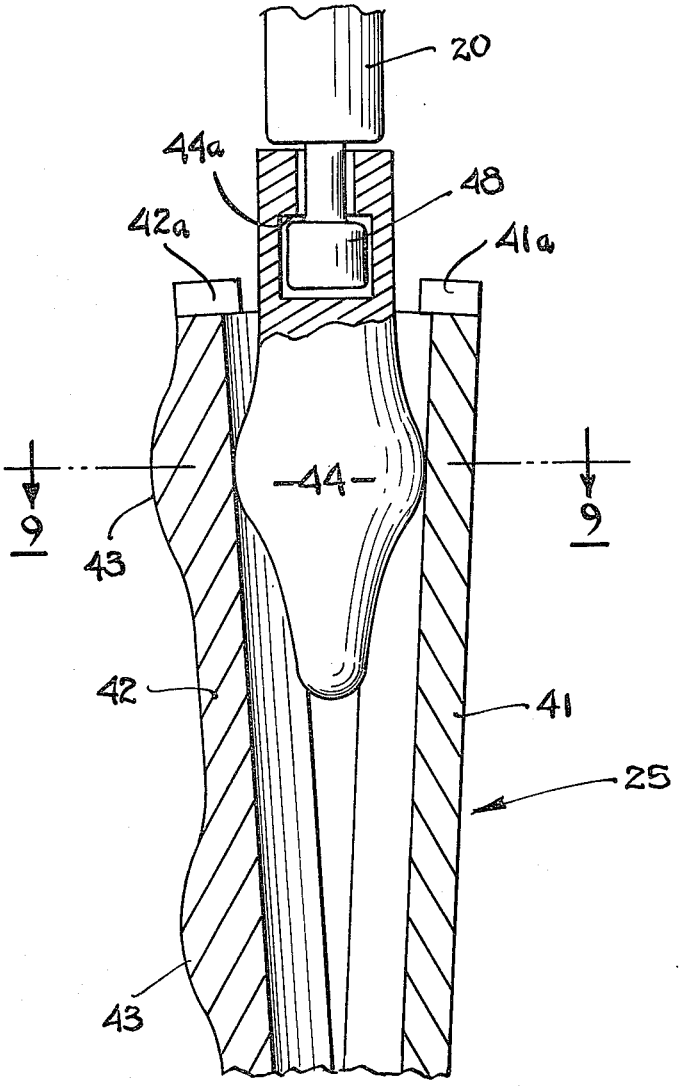
FIG. 8 is an elevational view in cross section of another embodiment of the invention.
Figure 9:
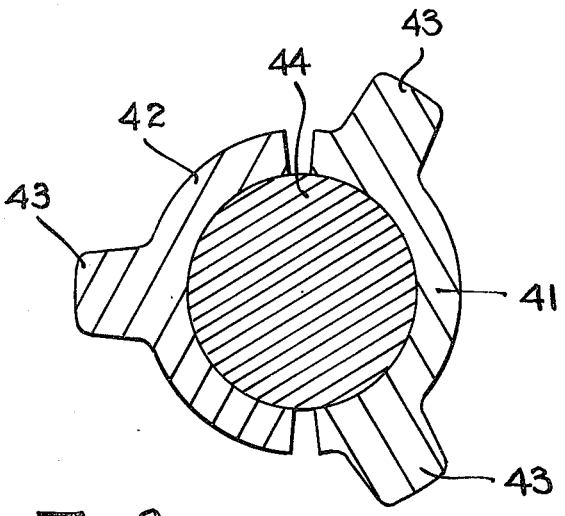
FIG. 9 is a cross-sectional view taken along the plane indicated by 9—9 in FIG. 8.

Referring now to FIGS. 8 and 9, a second embodiment of the tool of the invention is illustrated. In this embodiment, a pair of half sections 41 and 42 are initially loosely suspended on central ball expander portion 44 by means of ledges 41*a* and 42*a* formed along the top edges of the half sections. The half sections 41 and 42 along with ball expander 44 are thus suspended from stem 20 as a single integral unit. The tool 25 thus can be lowered down to the region of the well where fracturing is required. As for the previous embodiment, the tool has a plurality of ribs 43 formed on the outer surfaces thereof, these ribs being arranged with 120° circumferential spacing in the illustrative embodiment.

Rather than employing a tight rigid coupling between stem 20 and tool 25, a loose coupling is afforded by means of pin member 48 which is fixedly attached to stem 20 and is loosely fitted in receptacle 44*a* formed in the top portion of ball expander member 44. In this embodiment, the portion of the tool that contacts the sides of the well is more stationary as regards vertical vibration than the first embodiment. Although the tool has longitudinally split portions so that it has ample freedom of expansion to permit the ribs 43 to be driven into an elliptical stress mode, the freedom of motion vertically is restrained somewhat by the frictional contact of the ribs with the surrounding formation wall portions (not shown). Therefore, vertical freedom is found more in the ball expander portion 44 which is sonically driven in a longitudinal vibrational mode by the sonic energy. The downward progression of ball expander portion 44 gradually expands the half section portions 41 and 42 to create the desired non-isotropic elliptical stress.

It is further to be noted that in this embodiment, pin member 48, by virtue of its loose mounting within compartment 44*a*, forms a "sonic rectifier" which effectively provides unidirectional energy coupling between stem 20 and ball expander 44. Thus, with the ball expander member 44 pressed downwardly against half sections 41 and 42 by virtue of the bias force afforded by the weight of the ball, only the downward vibrational phase portions of the longitudinal vibration are transmitted to the ball from the stem. On the upper half strokes or phases of the vibration, the stem is effectively disconnected from the tool. We thus end up with a series of downward drive pulses without any upward pulses which minimizes the rubbing of the ball against the contacting surfaces of the half sections. Further, this feature affords reverse rectifier action when removing the coupling tool from the well. Under such conditions, an upward pull causes the shoulder on pin member 48 to pound against the opposing upper walls of compartment 44*a* of the tool which facilitates extraction of the tool.

In some well completion techniques, it is desirable to remove the fracturing tool and then install a perforated casing liner in the factured region in a conventional manner.

In certain formations that present wide differences in hardness in different radial directions around the well bore, it is sometimes not necessary to have ribs 25*a* or 43 because the rigidity of the formation contact regions such as 36 or 41 of tool 25 itself will cause sufficient non-istropic conditions in the non-uniform wall hardness around the bore in such formations.

While the invention has been described and illustrated in detail, it is to be clearly understood that this is intended by way of illustration and example only and is not to be taken by way of limitation, the spirit and scope of the invention being limited only by the terms of the following claims.

I claim:

1. A system for fracturing an earthen formation surrounding a well to engender an increased flow of fluid therefrom comprising:

an elastic stem member, a wedging tool attached to one end of said stem member, said wedging tool having wedging contact means formed on the outer surfaces thereof, means for suspending said stem member in said well with said contact means in vertically biased wedging engagement with a portion of said formation forming the walls of said well, means for generating sonic vibratory energy, and means for coupling said energy to said stem member to effect longitudinal elastic vibration of said stem member, the energy being coupled from said stem member to said wedging tool and thence to said formation in a non-isotropic manner, thereby to effect the fracturing thereof, said tool further including sonic rectifier means for providing unidirectional sonic pulses to the formation.

2. A system for fracturing an earthen formation surrounding a well to engender an increased flow of fluid therefrom comprising:

an elastic stem member, a wedging tool attached to one end of said stem member, said wedging tool having wedging contact means formed on the outer surfaces thereof, means for suspending said stem member in said well with said contact means in vertically biased wedging engagement with a portion of said formation forming the walls of said well, means for generating sonic vibratory energy, said tool including sonic rectifier means for converting said energy to unidirectional pulses, and means for coupling said energy to said stem member to effect longitudinal elastic vibration of said stem member, the energy being coupled from said stem member to said wedging tool and thence to said formation in a non-isotropic manner, thereby to effect the fracturing thereof.

3. A system for fracturing an earthen formation surrounding a well to engender an increased flow of fluid therefrom comprising:

an elastic stem member, a wedging tool attached to one end of said stem member, said wedging tool having wedging contact means, said contact means being capable of expanding outwardly and including a pair of separate longitudinal half sections having wedge means formed on the outer surfaces thereof, means for suspending said stem member in said well, means for expanding said contact means outwardly in vertically biased tight wedging engagement with a portion of said formation forming the walls of said well, said expanding means comprising a ball expander member contained between said half sections in engagement therewith but not attached thereto and means for coupling said ball expander member to said stem member, means for generating sonic vibratory energy, and means for coupling said energy to said stem member to effect longitudinal elastic vibration of said stem member, the energy being coupled from said stem member to said wedging tool and thence to said formation in a non-isotropic manner, thereby to effect the facturing thereof.

4. The system of claim 3 wherein the means for coupling the ball expander member to the stem member comprises a pin member fixedly attached to the stem and a receptacle formed in the top portion of the ball expander member for receiving the pin member in a loosely coupled joinder.

5. The system of claim 4 wherein the stem member and the receptacle form sonic rectifier means for coupling sonic energy between the stem member and the tool in unidirectional pulses.

6. A system for fracturing an earthen formation surrounding a well to engender an increased flow of fluid therefrom comprising:

an elastic stem member, a wedging tool attached to one end of said stem member, said wedging tool having a wedging contact means, said contact means being capable of expanding outwardly, said tool further including sonic rectifier means for providing unidirectional sonic pulses to the formation, means for suspending said stem member in said well, means for wedging said contact means outwardly in vertically biased tight wedging engagement with a portion of said formation forming the walls of said well, means for generating sonic vibratory energy, and means for coupling said energy to said stem member to effect longitudinal elastic vibration of said stem member, the energy being coupled from said stem member to said wedging tool and thence to said formation in a non-isotropic manner, thereby to effect the fracturing thereof.

7. A method for augmenting the flow of fluid from an earthen formation surrounding a well comprising the steps of placing an expandable wedge member in said well and wedging said wedge member outwardly in biased tight wedging engagement with a portion of the formation, feeding sonic energy to said wedge member such that such energy is transferred to the formation in unidirectional pulses non-isotropically to effect fracturing of the formation and horizontal expansion of the well bore, and downwardly biasing the wedge member while the sonic energy is being fed thereto to effect downward movement of the wedge member and successive horizontal expansion of the well bore.

* * * * *